US005572090A

United States Patent [19]

Carley

[11] Patent Number: 5,572,090

[45] Date of Patent: Nov. 5, 1996

[54] QUALITY LAMP AND METHOD FOR MAKING

[76] Inventor: James A. Carley, 1502 W. 228th St., Torrance, Calif. 90501

[21] Appl. No.: 516,819

[22] Filed: Aug. 18, 1995

[51] Int. Cl.[6] ..... H01J 17/04

[52] U.S. Cl. ..... 313/634

[58] Field of Search ..... 313/17, 26, 578, 313/580, 623, 626, 634, 635; 315/64, 75; 445/27; 439/617

[56] References Cited

U.S. PATENT DOCUMENTS

| | | | |
|---|---|---|---|
| 3,121,185 | 2/1964 | Poels et al. | 439/617 |
| 4,340,841 | 7/1982 | Schupp | 315/75 |
| 4,584,502 | 4/1986 | Kiesling et al. | 315/64 |

*Primary Examiner*—Walter E. Snow
*Assistant Examiner*—Mark Haynes
*Attorney, Agent, or Firm*—Curtis L. Harrington

[57] ABSTRACT

An incandescent lamp and method of making includes the placement of a hollow annular glass cylindrical insert within the glass envelope before fusing of the envelope to the bead takes place. The cylindrical insert is preferably made of an alumino silicate glass which has melting temperature about 200° C. higher than the melting temperature of the glass from which the glass envelope is made. The shaping and length of the hollow annular glass cylinder may be made to accommodate the shaping of the lens portion of the glass envelope. The higher melting temperature of the hollow annular glass cylinder will enable it to provide support to the glass envelope during the fusing process. The hollow annular glass cylinder will not enable the glass envelope to tilt to one side or the other, or to become compressed, bringing the lens portion closer to the filament, especially during the fusing operation when the final lamp is formed. With this device and method, waste in the high intensity lamp industry can be virtually eliminated.

8 Claims, 3 Drawing Sheets

QUALITY LAMP AND METHOD FOR MAKING

FIELD OF THE INVENTION

The present invention relates to the field of high intensity, efficient incandescent lamps, lenses, and a method for insuring consistent high quality in production.

BACKGROUND OF THE INVENTION

Incandescent lamps generally have been well known for several decades and have been employed in a wide variety of circumstances. In more commonplace applications the quality control considerations do not need to be particularly stringent. For example, in an ordinary light bulb, a displacement of a centimeter or two of the filament in the lamp will not severely affect lamp performance or safety.

For extremely small lamps, the absolute magnitude of the permissible variance of filament positioning is proportionately smaller. In small high intensity lamps, the permissible variance is significantly smaller than the ratio of the reduction in size. This is in part due to the higher efficiencies which are demanded from high intensity lamp use. In the very smallest of lamps, a lens is formed at the tip end of the lamp in order to better focus the light from the lamp. Of course, when the lamp is finally installed, a reflector may also be present to capture light emanating from the side of the lamp, in order that the light energy from the lamp be used most efficiently.

Ease of use in installing the lamps and in eliminating a permanent lens with the device have dictated that the lens be made integrally with the lamp. Even where the lamp is placed in a reflector system which enables the lamp to move axially with respect to the reflector, the light from the tip end of the lamp is not affected much by the reflector, and therefore the integration of the lens into the tip of the lamp is critical for proper treatment of light originating from the lamp's tip.

Thus the efficiency achieved by proper placement of the lens at the tip of the lamp contributes to the overall lamp efficiency. As has been explained, this measure of efficiency is somewhat independent of the efficiency regarding light which may captured from other directions, and must therefore be maximized to deliver a lamp which will enable a user to obtain the maximum overall efficiency.

Lamps are manufactured beginning with a small bead and a pair of metal conductors spaced apart and fixed with respect to the bead. A filament is attached between the upper extending metal conductors. The filament is usually made to exacting specifications and may be hand wound. In some instances which depend upon the shape of the filament and the point of attachment onto the conductors, a high consistency in orientation and dimensional spacing can be achieved. For example, where the conductors are straight and flatly terminated, and where the filament is precisely wound and with ends having defined length, consistent attachment can be achieved. This enables a consistent height of the conductors with respect to the bead to be translated into a consistent height of the filament with respect to the bead.

After the bead and filament assembly is finished, the glass envelope is placed over the assembly and to be fused and sealed with respect to the bead's outer circumference. The envelope tip end will typically contain material shaped in the form of a lens which may be convex-convex, convex-concave, or even concave-concave. A specialty gas may be introduced into the glass envelope to give long life to the filament, and perhaps to alter the character of the light from the completed lamp. The envelope is fused by raising the temperature of the bead, filament, and glass envelope assembly for a sufficient length of time for the glass envelope to fuse to the bead, and form an air tight enclosure for the filament and the filament's surroundings. This traditional way of producing high intensity lamps has resulted in problems regarding the quality and consistency of the resulting product.

First, there is no control over the extent to which the envelope axially moves down over the bead and filament. Even if all else goes well in the manufacturing operation, there will be a high variance with regard to the target spacing between the filament and the lens at the tip end of the glass envelope. At best, the glass envelope will flow downwardly toward the bead, and at worst, the lateral sides of the glass envelope will become deformed inwardly or outwardly.

Secondly, the weakest structural integrity of the bead, filament, and glass envelope assembly is the peripheral sides of the glass envelope from a point just above its contact with the bead and upwardly to the lens formed area of the tip end of the glass envelope. Even though the glass envelope is very small, and the weight of the lens portion is very slight, the high temperature process of fusing the glass envelope to the bead can cause the glass envelope to deform. The physical characteristics of deformity include an axial lowering of the lens in the direction of the filament, as well as the more prevalent tilting of the glass envelope to one side. The tilting of the glass envelope points the lens off to one side and typically lowers one side of the glass envelope. This can bring the filament close to the inside surface of the lamp.

A filament too close to the edge of the lamp will not only defeat the purpose of the lens formed at the tip end of the glass envelope, but will also obscure light emanating from the circumference of the lamp to further defeat the efficient use of the lamp with a reflector.

Of course, the manufacturer could simply manufacture the lamps in large numbers and simply discard the lamps which are not formed to specification. The variance of production under these circumstances are so great as to eliminate the discard of lamps without doing more to increase efficiency.

One solution to this problem has been to form the upper ends of the conductors into a shape where their lengths approach each other and then flare outwardly and upwardly. This is also known as a Y-mount. The main idea behind the Y-mount is to have the conductors engage the lens area of the glass envelope and to hold it in place during fusion of the assembly to develop some dimensional consistency in the finished product.

Although the Y-mount may serve to help prevent some gross deformities which occur in the final assembly, a number of problems prevent this technique from effective use to produce a highly uniform product with a small error tolerance. First, the target for attachment of the filament is not as readily indicated in the Y-mount. The assembler, instead of having a definitely marked point on each conductor to attach the filament, now has a first vertically curved area for attachment of a first end of the filament and a second vertically curved area for attachment of a second end of the filament.

This enables the assembler to have a vertically expanded choice of attachment points along the two vertical conductors. This can result in filaments which may be slanted upwardly or slanted downwardly or mounted horizontal and slightly upwardly or horizontal and slightly downwardly. Thus the Y-mount automatically introduces variance of the filament with respect to the bead.

Secondly, the Y-mount has been known to physically invade the glass envelope during the fusing of the glass envelope to the bead, and thus deform the lens portion. This is due to the relatively smaller surface area of the tip of the conductors with respect to the relatively larger area and weight of the glass envelope. Where the ends of the Y-mount "invade" the glass envelope, the lens portion of the glass envelope is also brought overly close to the filament. Where the lens and filament are too close, proper focus is again degraded. So not only is the filament height practically impossible to control on the conductors in the Y-mount, but the height of the lens with respect to the conductors of the Y-mount is similarly difficult to control. In addition, more labor is involved in placing a filament to a Y-mount since the installer must avoid bending the top portions of the "Y".

As a result of these factors, no acceptable mechanism has been developed for precision placement of glass envelopes onto bead and filament assemblies. The needed mechanism should provide for exact lens to filament placement and absolutely minimize any changes which would occur during the fusing process. The needed mechanism would not invade and deform the lens portion. Even more importantly and beyond the overt disadvantages of the prior art, the manufacturing process needs to include the ability of verifying the spacing between the filament and lens portion of the glass envelope. Even more important of a need is to be able to change the spacing before the fusing process, in order to eliminate the need to discard the unfused assembly. Currently, even neglecting the problems which can occur during the fusing step, there is little or nothing which can be done where a visual inspection reveals an assembly which is out of specification. The only alternative is to discard the unfused assembly, or try to identify the faulty component and perhaps use the non-faulty component with another non-faulty portion. These alternatives are expensive and time consuming, respectively. Therefore, the ability to check the unfused lamp for dimensional tolerance, and then to actually correct the lamps before fusing would be highly valued.

SUMMARY OF THE INVENTION

The incandescent lamp and method of making includes the placement of a hollow annular glass cylinder within the glass envelope before fusing of the envelope to the bead takes place. The hollow annular glass cylinder is preferably made of an alumino silicate glass which has a melting temperature about 200° C. higher than the melting temperature of the glass from which the glass envelope is made. The hollow annular glass cylinder is then used as an insert within the glass envelope to provide enhanced strength and as an insert spacer.

The shaping and length of the hollow annular glass cylinder may be made to accommodate the shaping of the lens portion of the glass envelope. The higher melting temperature of the hollow annular glass cylinder will enable it to provide support to the glass envelope during the fusing process. The hollow annular glass cylinder will not enable the glass envelope to tilt to one side or the other, or to become compressed, bringing the lens portion closer to the filament.

Even more importantly during the manufacturing process, the assembler can be provided with several discrete lengths of hollow annular glass cylinder. The provision of a defined length member between the glass envelope and bead supporting the filament will make the average filament to lens dimension have less deviation. Once assembled and before the fusing step, the spacing between the filament and the lens portion of the glass envelope can be visually measured. In instances where the conductors supporting the filament are too long or too short, thus affecting the filament lens spacing, a substitute hollow annular glass cylinder can be added which may be a few thousandths longer or shorter, to bring the assembly into tolerance range. With this device and method, waste in the high intensity lamp industry can be virtually eliminated. After the fusing step, a uniformly high quality lamp is produced.

BRIEF DESCRIPTION OF THE DRAWINGS

These and other aspects of the invention will be better understood from the following description in which reference is made to several drawings of which.

DETAILED DESCRIPTION OF THE PREFERRED EMBODIMENT

Figure 1:
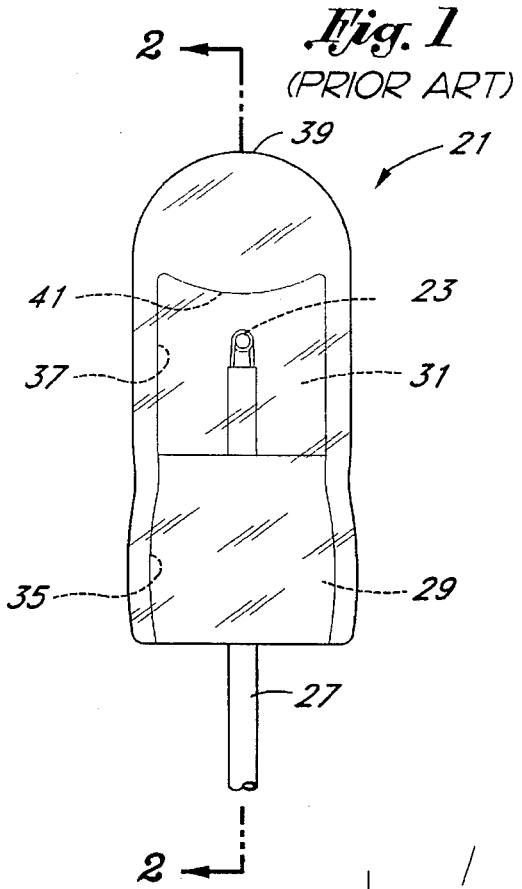
Fig. 1 (PRIOR ART)
FIG. 1 is a side view of a prior art lamp illustrating glass envelope, and filament orientation.
Figure 2:
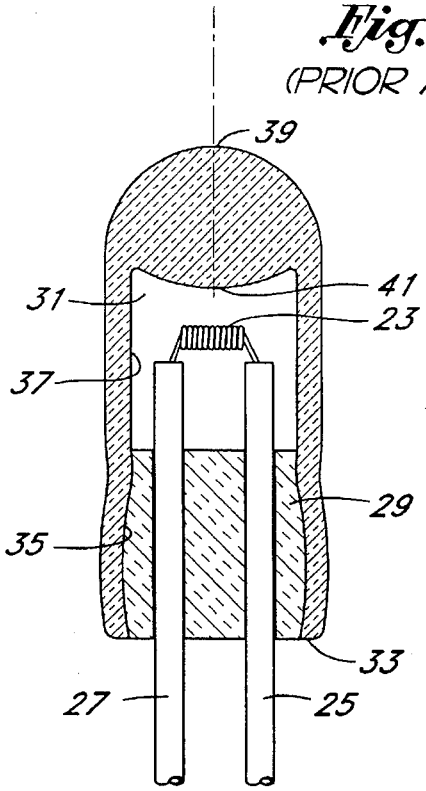
Fig. 2 (PRIOR ART)
FIG. 2 is a sectional view taken along line 2—2 of FIG. 1.

FIGS. 1 and 2 show a small incandescent lamp 21 of a well known construction, typically used for high intensity lamp applications. The lamp 21 includes a filament 23 that is attached at either of its ends to an upright pair of conductors which will hereafter be referred to as filament support legs 25 and 27 which are supported in a spaced apart orientation. The filament support legs 25 and 27 extend through and are supported by a bead portion 29. The lengths of the filament support legs 25 and 27 which extend below the bead portion 29 may be further used as connectors to be plugged into a female receptacle or may be attached to a base for use in a wide variety of applications.

The filament 23 and upper portions of the support legs 25 and 27 stand within a space 31 into which a specialty gas may be introduced to affect the quality of the light given off by the filament 23. Surrounding the space 31, filament 23, and upper portion of the filament support legs 25 and 27 is a glass envelope 33. Glass envelope 33 has a number of portions. Portion 35 of glass envelope 33 is sealingly opposed to the glass bead 29. Portion 37 of the glass envelope encloses the periphery of the space 31. The glass envelope has a tip end 39 and an inside end surface 41. The shape of the tip end 39 and inside end surface 41 combine to form a convex-convex lens with respect to light leaving the lamp 21 in the upward direction. The spacing between the filament 23 and the inside end surface 41 is an important dimension in the lamp 21, and can significantly affect the distribution of light leaving the tip end 39 of the lamp 21.

Figure 3:
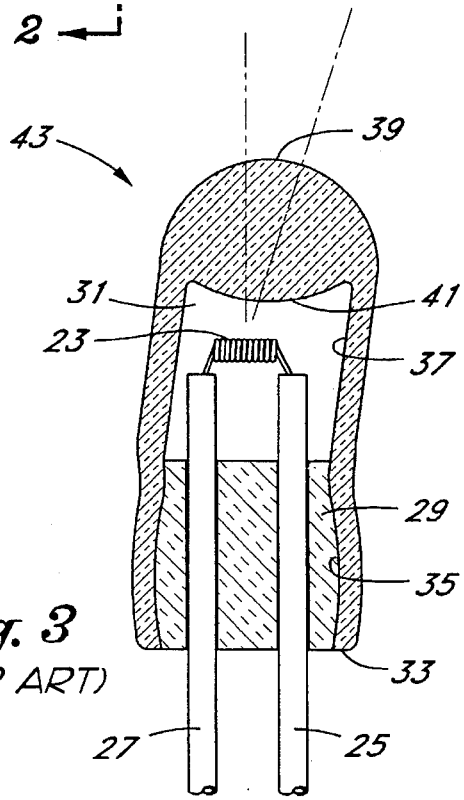
Fig. 3 (PRIOR ART)
FIG. 3 is a sectional view of a lamp, similar to the view of FIG. 2, in which the lamp has undergone tilting due to the one sided melting of the glass envelope.
Figure 4:
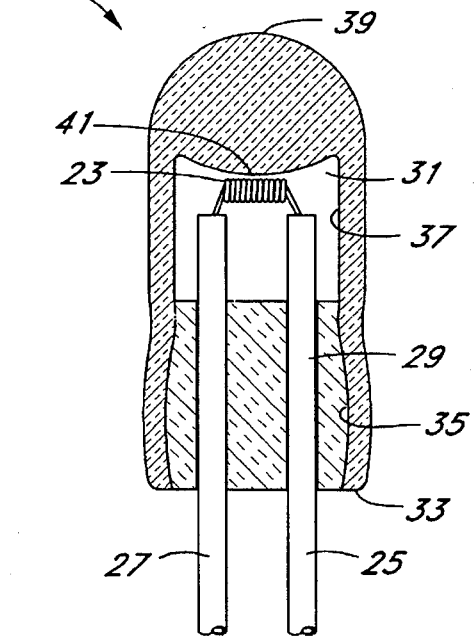
Fig. 4 (PRIOR ART)
FIG. 4 is a sectional view of a lamp, similar to the view of FIG. 2, in which the glass envelope of the lamp has undergone a lowering, significantly decreasing the spacing between the inner surface and the filament.

FIG. 3 illustrates a sectional view of a tilted lamp 43. Note that the lens formed between tip end 39 and inside end surface 41 is shifted to one side and brought slightly closer to the filament 23. FIG. 4 illustrates a lamp 45 in which the glass envelope 33 has shifted downwardly or flowed along the bead 29 to grossly decrease the filament 23 and inside end surface 41 spacing. In some cases, portions of the glass envelope 33 may flow and bunch on one side.

Figure 5:
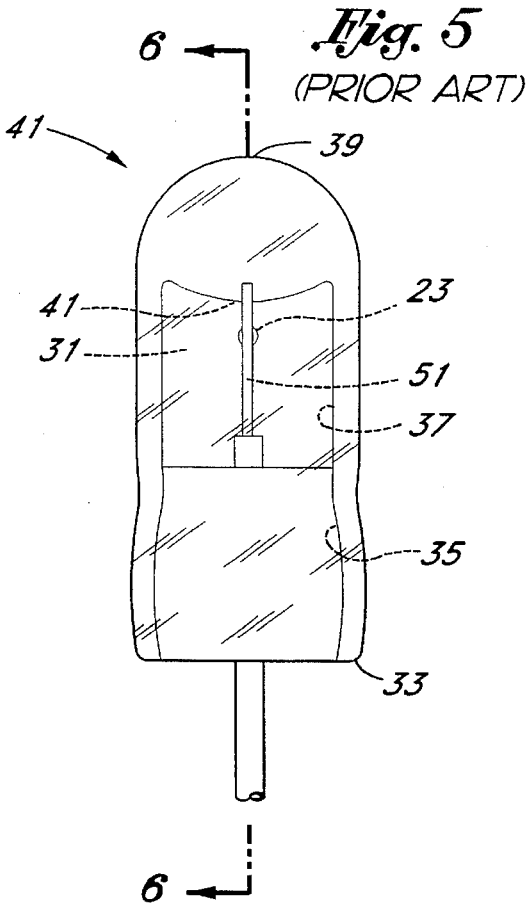
Fig. 5 (PRIOR ART)
FIG. 5 is a side view of a second prior art lamp employing a "Y-mount", and illustrating glass envelope, and filament orientation.
Figure 6:
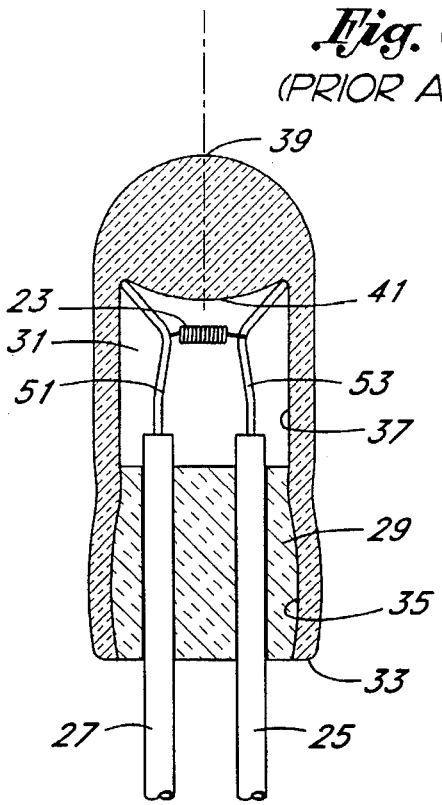
Fig. 6 (PRIOR ART)
FIG. 6 is a sectional view taken along line 6—6 of FIG. 5.
Figure 7:
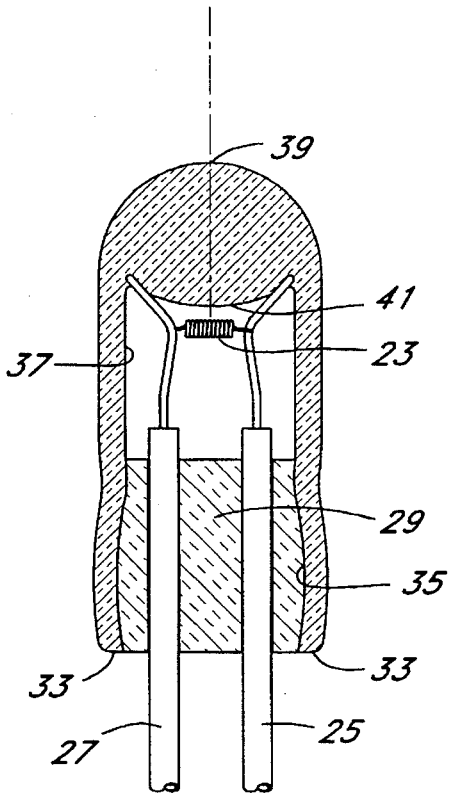
Fig. 7 (PRIOR ART)
FIG. 7 is a sectional view of the Y-mount lamp, similar to the view of FIG. 6, in which the lamp has undergone an invasion into the upper portion of the glass envelope area by the specially formed ends of the support legs, thus decreasing the spacing between the inner surface and the filament.

Referring to FIGS. 5, 6, and 7, an illustration of a "Y-mount" lamp 49 is shown. The "Y" portion of the filament support legs 25 and 27 have specially formed ends 51 and 53 which include a pair of opposing curved portions onto which the filament is mounted. The tip ends of the formed ends 51 and 53, as is shown in FIG. 7 can invade the upper end of the glass envelope 33. This will again decrease the spacing between filament 23 and inside end surface 41. Further, the use of the Y-mount lamp 49 involves additional time and labor to form the formed ends 51 and 53, and also introduces error in the placement of the filament 23 by presenting a lesser defined area for filament attachment.

Figure 8:
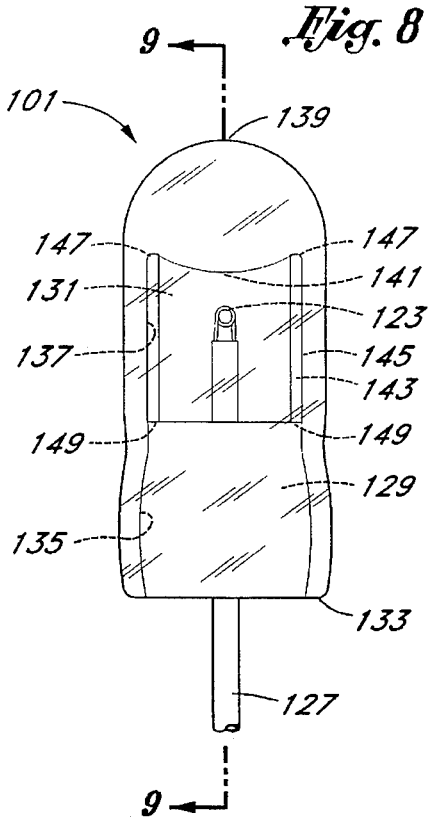
FIG. 8 is a side view of the lamp of the present invention and illustrating the use of a hollow glass cylindrical insert within the glass envelope.
Figure 9:
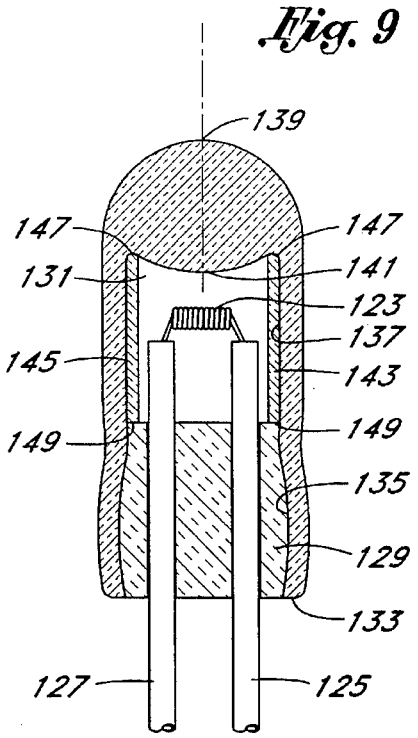
FIG. 9 is a sectional view taken along line 9—9 of FIG. 8.

Referring to FIGS. 8 and 9, a lamp 101 is illustrated which embodies the structure and advantages of the present invention. The lamp 101 includes a filament 123 that is attached at either of its ends to filament support legs 125 and 127 which are spaced apart conductors. The filament support legs 125 and 127 extend through a bead portion 129. The lengths of the filament support legs 125 and 127 which extend below the bead portion 129 may be further used as connectors to be plugged into a female receptacle or may be attached to a base for use in a wide variety of applications. Typically the extent to which the support legs 125 and 127 extend above the bead portion 129 can be precisely controlled during the manufacturing process.

The filament 123 and upper portions of the support legs 125 and 127 stand within a space 131 into which a specialty gas may be introduced to affect the quality of the light given off by the filament 123. Surrounding the space 131, filament 123, and upper portion of the filament support legs 125 and 127 is a glass envelope 133. Glass envelope 133 has a number of portions. Portion 135 of glass envelope 133 is sealingly opposed to the glass bead 129. Portion 137 of the glass envelope 133 encloses the periphery of the space 131. The glass envelope has a tip end 139 and an inside end surface 141. The shape of the tip end 139 and inside end surface 141 combine to form a convex-convex lens with respect to light leaving the lamp 101 in the upward direction. The spacing between the filament 123 and the inside end surface 141 is an important dimension in the lamp 101, and as will be shown can not only be controlled, but can be changed before the fusing step in which the completed lamp 101 is formed. Thus, the formed lamp will have accurate distribution of light leaving the tip end 139.

As shown in FIGS. 8 and 9, there is a hollow, open ended cylindrical glass insert 143. The glass insert 143 has a continuous curved outer surface 145 which opposes the portion 137 of the glass envelope 133. Hollow, open ended cylindrical glass insert 143 has a circular upper surface 147 which abuts the inside of the glass envelope 133 at the outer edges of the inside end surface 141. Hollow, open ended cylindrical glass insert 143 also has a circular lower surface 149 which abuts the inside of the glass envelope 133 at the outer edges of the bead portion 129.

The cylindrical glass insert 143 need not be open ended at both ends. For example, the end adjacent the upper surface 147 could be closed in to form a cup. The end of the cup could conform to the inside surface of the glass envelope 133. Of course as is seen in FIG. 9, the inside end surface 141 is allowed to dip down within the internal volume of the cylindrical glass insert 143. In other instances where it would be important to provide an exact internal spacing above the filament 123, a closed ended cylindrical glass insert 143 could be advantageous. In the manufacturing design, such a move would allow the loading of the tighter precision specifications onto the cylindrical glass insert 143, rather than tighter dimensioning of the glass envelope 133.

In the preferred embodiment of FIGS. 8 and 9, the cylindrical glass insert 143 will be made of a material which melts from about 50° C. to about 350° C. higher than the melting temperature of the glass envelope 133. Most preferably, the material of the cylindrical glass insert 143 will melt at about 200° C. higher than the melting temperature of the glass envelope 133. This higher melting temperature can be achieved by employing an alumino silicate glass in which the melting temperature can be controlled by adding aluminum compound.

Figure 10:
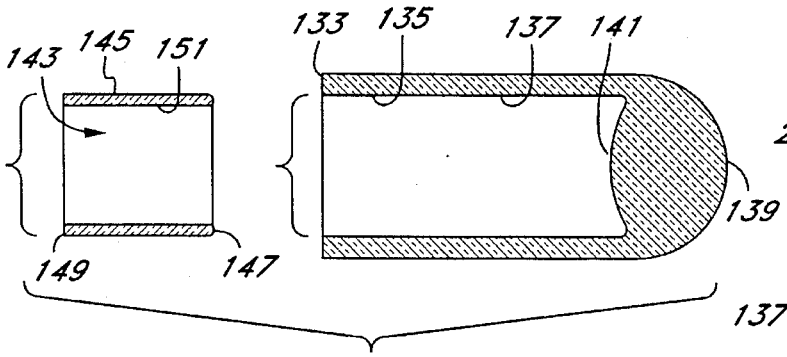
FIG. 10 is an exploded view of the hollow glass cylindrical insert shown in relationship to the glass envelope before formation of the lamp of the present invention thus illustrating that it may be inserted during lamp formation.

The cylindrical glass insert 143 will be manufactured to exacting specifications, and particularly the length of its annular cylindrical body. Further, the cylindrical glass insert 143 will be available in a variety of finely varying lengths to enable assemblers of the lamp 101 to use the cylindrical glass inserts 143 as pre-selected length spacers. During assembly, the bead 129, filament support legs 125 and 127 and the filament 123 will likely exist as an assembly to which the glass envelope 133 and cylindrical glass insert 143 will be added. Referring to FIG. 10, a sectional view of the glass envelope 133 and cylindrical glass insert 143 better illustrate their dimensional relationship during assembly.

Again assuming that the bead 129, filament support legs 125 and 127 and the filament 123 are formed into a complete assembly, hereinafter the bead assembly, the cylindrical glass insert 143 can be inserted within the glass envelope 133 the glass envelope-cylindrical glass insert 133/143 can then be fitted atop the formed bead assembly to form a completed assembly. The completed assembly can then be inspected to verify the distance between the filament 123 and the inside end surface 141 to determine if it is within a pre-determined tolerance. Where this dimension is outside of tolerance, the glass envelope 133 and cylindrical glass insert 143 can be removed from the bead assembly. The cylindrical glass insert 143 can then be removed from the glass envelope 133 and replaced with a second cylindrical glass insert 143 of a different axial dimension.

Where the dimension between the filament 123 and the inside end surface 141 has been found to be too great and out of tolerance, the second cylindrical glass insert 143 of shorter axial dimension can be selected, and the completed assembly again made up with the new cylindrical glass insert 143. The re-constituted assembly can then be re-inspected to see if the distance between the filament 123 and the inside end surface 141 is within a predetermined tolerance. Conversely where the dimension between the filament 123 and the inside end surface 141 has been found to be too small and out of tolerance, the second cylindrical glass insert 143 of longer axial dimension can be selected, and the completed assembly again made up with the new cylindrical glass insert 143.

In this manner, each one of the lamps 101 can be preassembled and inspected to insure that they are within specification before the fusing step. During the fusing step, heat is added which will cause the glass envelope 133 to bond to the bead portion 129 and seal the space 131 which contains any specialty gas present. The inner portion 137 of the glass envelope 133 may also fuse to the curved outer surface 145 of the cylindrical glass insert 43. In any event, the fusion will cause all of the interfitting parts of the lamp 101 to be fixed together in a fully attached orientation.

During the fusing operation, the cylindrical glass insert 143, which has a melting temperature of about 200° higher than the melting temperature of the glass envelope 133, will prevent tilting of the glass envelope 133 during the fusing operation. Further, the cylindrical glass insert 143 will prevent the vertical collapse of the glass envelope 133. Since the cylindrical glass insert 143 has substantial support from the bead portion 129, this support is transmitted to the upper portion of the glass envelope 133. During the fusing operation, the portion 135 of the glass envelope 133 will immediately begin to fuse with the bead portion 129, and needs no further support. However, the weakest portion of the glass envelope 133 during fusing, absent the presence of the insert 143 would be the side walls, including portion 137 which would have no other structure from which to draw support. Thus the cylindrical glass insert 143 lends support not only by holding up the upper portion of the glass envelope 133 having the lens forming surfaces 139 and 141, but also may provide a surface 145 onto which the portion 137 of the glass envelope 133 may begin to bond. Thus the insert 143 may serve as both a vertical spacer, and as a provider of bonding area to the inside of the glass envelope 133.

Since the fusing step may occur rapidly, it is unlikely that the bulk of the material of the glass envelope 133 between the surfaces 141 and 139 will have a chance to deform while being supported by the continuous surface of the upper end 147 of the cylindrical glass insert 143.

Further, and as seen in FIG. 10, the cylindrical glass insert 143 has an internal surface 151. It is surface 151 which will physically lie adjacent to the filament 123. Thus the higher temperature surface will lie adjacent the filament 123, lending greater temperature integrity to the lamp. Further, the presence of a relatively harder material, in the form of glass insert 43, will result in a lamp 101 having increased physical integrity.

The glass insert 143 may have an outer diameter of about 0.1 inches, to match an internal diameter of the glass envelope 133 of about 0.11 inches. The measure of radial clearance between the glass envelope 133 and the cylindrical glass insert 143 will depend upon the tollerancing levels at which these structures are available, to avoid mismatch and interference in fit. The thickness of the glass envelope 133 may vary, and may be reduced due to the presence of the cylindrical glass insert 143 since there will be a reduced need for structural support from the peripheral sides of the glass envelope 133.

The surfaces 139 and 141 which form a convex-convex lens at the end of the glass envelope 133 can vary in size and shape. Either or both surfaces can be made concave to give a different optical character to the light emitted from the top of the glass envelope 133. For example, a concave-concave arrangement would tend to spread the light away from the axis extending away from the lamp 101. Any number of arrangements are possible.

Figure 11:
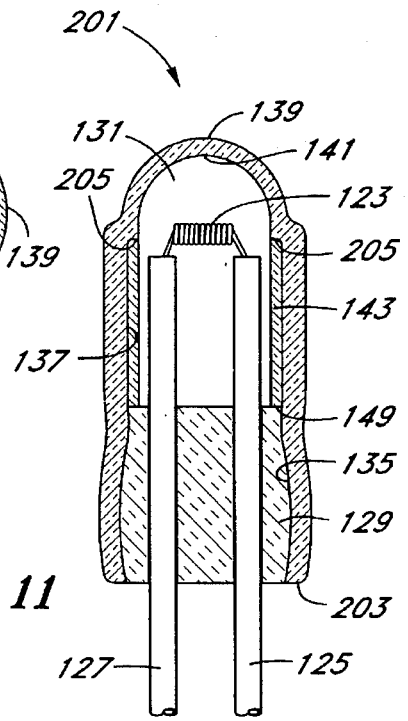
FIG. 11 is a second embodiment of the lamp of the present invention where the tip end is not formed into a lens, but illustrating the use of the hollow glass cylindrical insert to enable more exact spacing of the filament within and close to the tip end of a glass envelope.

Referring to FIG. 11, a second embodiment of a lamp of the present invention is shown as lamp 201. Identity numbers for the component parts of lamp 201 will be the same as for lamp 101, with the exception of glass envelope 203 which is different. Rather than having a significant volume of material between the tip end 139 and an inside end surface 141, the inside end surface 141 is congruous with the tip end 139 to form a radial shape to simply provide light transmission.

Further, the glass envelope 203 has a pair of shoulders 205 to oppose and interfit with the upper surface 147 of cylindrical glass insert 143. This arrangement provides a much more conforming fit. The radial shape of the upper end of the glass envelope 203 is such as to provide maximum light transmission and maximum radial view through the upper end of the glass envelope 203. Again, the cylindrical glass insert 143 can be used for enhanced structural integrity, as well as for more specific spacing requirements. As is the case in FIG. 11, when the filament 123 is moved closer to a thinner section of the glass envelope 203, control of the spacing of the filament 123 with respect to the upper end of the envelope may be more critical. The combination of structures comprising lamp 201 enable a better, more precisely controlled product.

A great number of variations on the embodiment shown are possible and are likely to occur to workers and technicians in this field. These variations are considered to be comprehended by the present invention which is limited only by the following claims.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. An electric lamp comprising:

a bead portion supporting and sealing about a pair of spaced apart electrical conductors each having a terminated end above said bead portion;

a filament having a first end attached near a terminated end of one of said pair of conductors, and a second end attached near a terminated end of the other of said pair of conductors;

a hollow glass cylindrical insert having a cylindrical outer surface and a cylindrical inner surface bound by a first end and a second open end, said second end abutting said bead portion;

a glass envelope having an outside surface, a first inside circumferential surface portion opposing said bead portion, a second circumferential surface portion opposing said cylindrical outer surface of said hollow glass cylindrical insert, and an inside end surface adjacent said first end of said hollow glass cylindrical insert.

2. The electric lamp as recited in claim 1 wherein the melting temperature of said hollow glass cylindrical insert is from about 50° C. to about 350° C. higher than the melting temperature of said glass envelope.

3. The electric lamp as recited in claim 2 wherein the melting temperature of said hollow glass cylindrical insert is 200° C. higher than the melting temperature of said glass envelope.

4. The electric lamp as recited in claim 1 wherein said first end of said hollow glass cylindrical insert is open.

5. The electric lamp as recited in claim 1 wherein said pair of spaced apart electrical conductors also extend below said bead portion to form a pair of plug connection terminals.

6. The electric lamp as recited in claim 1 wherein said glass envelope has a tip outside end and a volume of material between said inside end surface of said glass envelope and said tip outside end forming an optical lens portion.

7. The electric lamp as recited in claim 6 wherein said optical lens portion is convex-convex.

8. The electric lamp as recited in claim 7 wherein said first end of said hollow glass cylindrical insert is open and wherein said inside end surface of said glass envelope extends within said hollow glass cylindrical insert.

* * * * *